US006325259B1

(12) United States Patent
Tharalson et al.

(10) Patent No.: US 6,325,259 B1
(45) Date of Patent: Dec. 4, 2001

(54) HIP POUCH BABY CARRIER

(75) Inventors: Douglas A. Tharalson; Diana M. Tharalson, both of Agoura; Dan Peterson, Thousand Oaks, all of CA (US)

(73) Assignee: Arms Reach Concepts, Inc., Malibu, CA (US)

( * ) Notice: Subject to any disclaimer, the term of this patent is extended or adjusted under 35 U.S.C. 154(b) by 0 days.

(21) Appl. No.: 09/570,496

(22) Filed: May 13, 2000

(51) Int. Cl.[7] ..... A61G 1/00
(52) U.S. Cl. ..... 224/161; 224/159; 224/601
(58) Field of Search ..... 224/161, 159, 224/601

(56) References Cited

U.S. PATENT DOCUMENTS

| | | | | |
|---|---|---|---|---|
| 5,224,637 | * | 7/1993 | Colombo | 224/159 |
| 5,292,042 | * | 3/1994 | Yamaguchi et al. | 224/159 |
| 5,492,256 | * | 2/1996 | Ive | 224/159 |
| 5,641,101 | * | 6/1997 | Nakayama | 224/159 |
| 5,711,466 | * | 1/1998 | Kataoka et al. | 224/159 |
| 5,934,528 | * | 8/1999 | Higuchi | 224/159 |

* cited by examiner

*Primary Examiner*—Stephen K. Cronin
*Assistant Examiner*—Maerena W. Brevard
(74) *Attorney, Agent, or Firm*—David A. Belasco; Beehler & Pavitt

(57) ABSTRACT

A hip pouch storage device that converts easily to a secure baby carrier. The hip pouch has a first end, a second end, a top surface, an inner surface and an outer surface. The hip pouch includes an adjustable length waist strap that attaches to the first and second ends of the hip pouch. The hip pouch includes a first pocket located on the inner surface of the pouch. A support sling that has an inner surface, an outer surface, a first side, a second side, a lower attachment point and first and second upper attachment points is provided. The support sling is fixedly attached to the interior surface of the first pocket and includes an adjustable length neck strap attached to the first and second upper attachment points of the support sling. A neck pad may be provided to fit slidably upon the neck strap. In use, the hip pouch is attached to the wearer about the waist with the waist strap and the support sling is extended from the first pocket and the neck strap placed over the wearer's head about the neck. A baby is constrained within the support sling with a leg located on either side of the support sling. The baby rests on the top surface of the hip pouch. A variation of the invention further includes a leg and back strap extending from the first side of the support sling adjacent the lower attachment point, across the outer surface of the sling and back to the second side of the sling. This arrangement provides a pair of leg openings to further secure the baby within the support sling. The support sling may be fabricated from mesh material. A second pocket may be provided on the outer surface of the hip pouch to contain a collapsible beverage container sling. This beverage container sling is fixedly attached to the interior surface of the second pocket. The hip pouch provides additional interior storage space and may have additional external storage pockets attached.

6 Claims, 2 Drawing Sheets

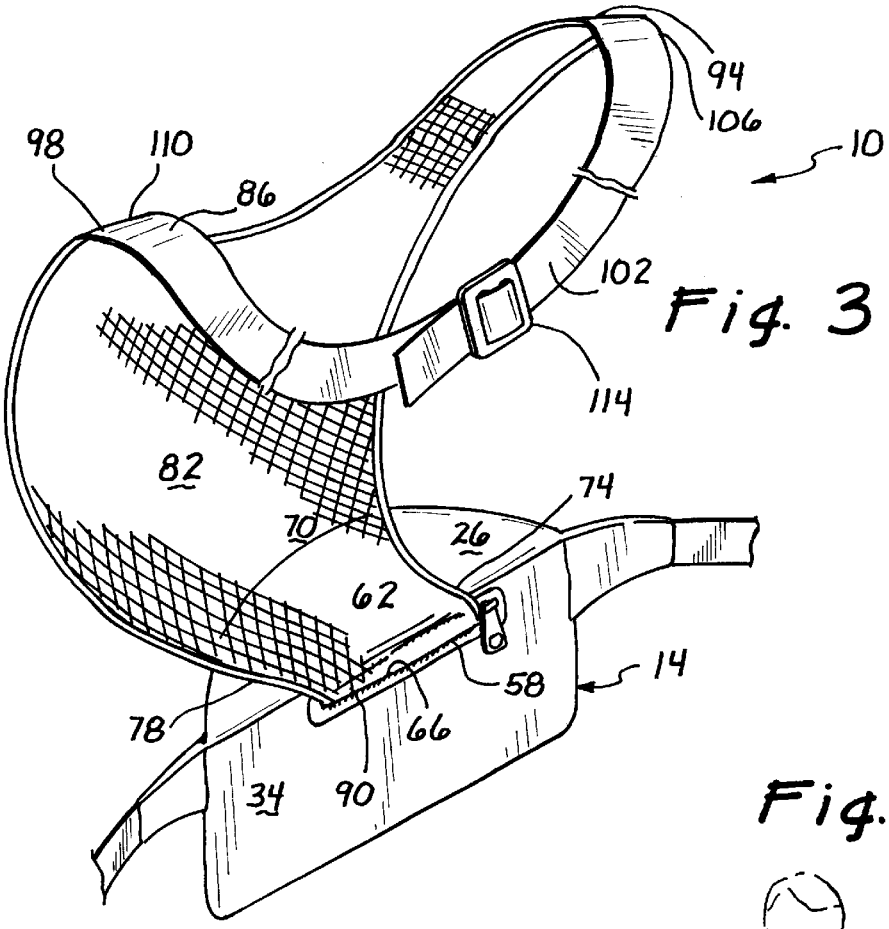
Fig. 3
Fig. 4
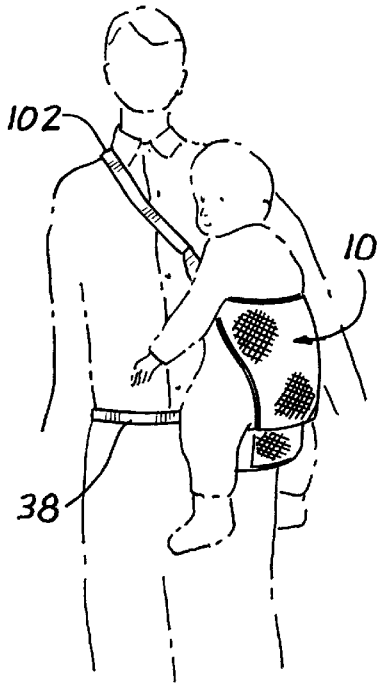
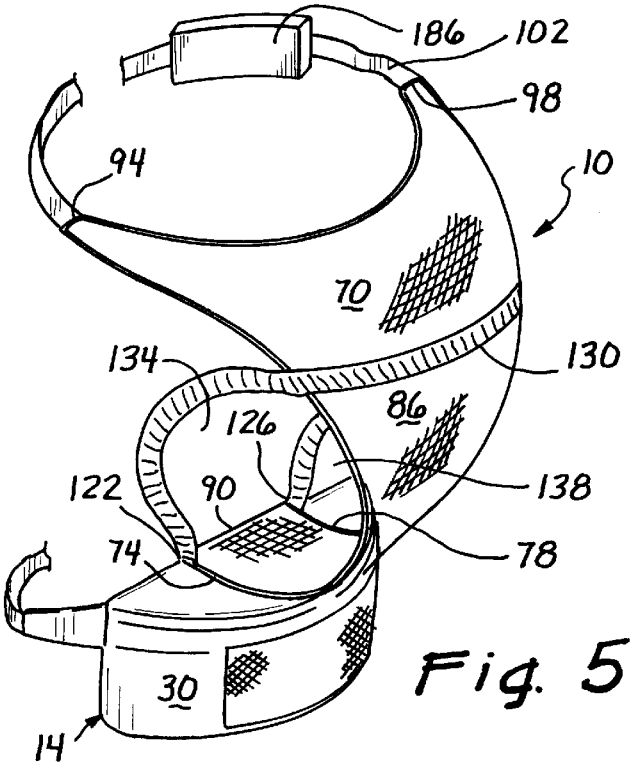
Fig. 5

HIP POUCH BABY CARRIER

FIELD OF THE INVENTION

The instant invention relates to the field of carriers adapted to be worn by an adult to support and carry an infant or young child. In particular, the present invention concerns child carriers that can be easily folded and stored in a small pouch and opened to provide a secure carrying unit disposed on the adult's hip.

BACKGROUND OF THE INVENTION

Since ancient times parents, particularly mothers, have created various devices to assist them to carry infants and young children when walking. Traditionally, most baby carriers have been designed for use by women. As parenting chores are often shared between both parents today, it has become increasingly important that baby carriers are available that will complement both male and female fashions and clothing styles. The prior art contains many examples of devices adapted to carry babies in a variety of ways.

In U.S. Pat. No. 5,492,256, issued to Ive teaches a belt-mounted hip pouch that serves as a platform on which the infant sits. The pouch contains a folding neck harness attached to the outer edge of the pouch that is secured to the neck of the adult. U.S. Pat. No. 5,711,466, issued to Kataoka et al. discloses a baby holder in combination with a hip pouch. The carrier includes a waist strap, a neck strap and a folding pad wall designed to serve as either a back rest or front safety restraint for the baby, depending upon his orientation in the carrier. Yamaguchi adds a triangular piece of cloth or leather to the shoulder strap to provide additional support for the baby. The shoulder strap in this invention is also attached to the outer edge of the pouch. (U.S. Pat. No. 5,195,666). U.S. Pat. No. 5,657,912, issued to Nakayama is similar to Yamaguchi and adds an additional auxiliary strap above the triangular piece, to further support the baby's back.

It is an objective of the present invention to provide a compact, lightweight baby carrier that may be easily stowed in a small hip-mounted pouch. It is a further objective of the invention to provide a carrier that will allow the infant to be carried either facing towards or away from the adult wearing the carrier. It is still a further objective of the present invention that the carrier provide firm support for the baby's backside while ensuring that the baby can not slip inadvertently from the carrier. It is yet a further objective of the invention that the unit is comfortable for both the adult and the baby in walking and standing uses. It is another objective of the present invention that the carrier be adjustable for different size adults and babies. Finally, it is an objective of the invention that the carrier be compatible with both women's and men's fashions.

Other features and advantages of the invention will be seen from the following description and drawings.

SUMMARY OF THE INVENTION

The present invention is a hip pouch baby carrier that may be easily converted into a secure baby carrier. The hip pouch baby carrier may be constructed from the following components. A hip pouch fabricated from flexible material is provided. The hip pouch has a first end, an opposite second end, a top surface, an outer surface and an inner surface.

An adjustable length waist strap is provided. The waist strap has a first end, a second end, a detachable coupling means and an adjustment means located between the first and second ends. The waist strap is attached at its first end to the first end of the hip pouch and at its second end to the second end of the hip pouch.

A first pocket located on the inner surface of the hip pouch is provided. The first pocket has a top opening and an interior surface. A collapsible support sling is provided. The support sling has a first side, a second side, an inner surface, an outer surface, a lower attachment point and first and second upper attachment points. The support sling is fixedly attached to the interior surface of the first pocket.

An adjustable length neck strap is provided. The neck strap has a first end, a second end and a length adjustment means. The neck strap is fixedly attached at its first end to the first upper attachment point of the support sling and at its second end to the second upper attachment point of the support sling.

The support sling is sized, shaped and located to secure a baby against the hip of a wearer with the baby resting upon the top surface of the hip pouch with each of its legs disposed over one of the first and second sides of the sling. The support sling and the neck strap are sized, shaped and located to be storable within the first pocket when not needed to support a baby.

In a variation of the invention, the hip pouch baby carrier further comprises a leg and back strap. The leg and back strap has a first end, a second end and an intermediate portion. The leg and back strap is fixedly attached at the first end to the first side of the support sling adjacent the lower attachment point. It is attached at its intermediate portion to the outer surface of the support sling between the first and second upper attachment points and the lower attachment point. The leg and back strap is attached at its second end to the second side adjacent the lower attachment point.

The leg and back strap provides a first leg opening formed between the leg and back strap and the first side of the support sling and a second leg opening formed between the leg and back strap and the second side of the support sling. In use, when a baby is placed in the support sling with a first leg in the first leg opening and a second leg in the second leg opening the baby will be constrained from slipping out of the support sling.

In another variation of the invention, the leg and back strap is formed of elastic material.

In still another variation of the invention, a second pocket is provided. The second pocket has a top opening and an interior surface. A container sling is provided. The container sling is formed of flexible material and has an open top, a closed bottom and at least one side wall joining the top and the bottom. The container sling is fixedly attached to the interior surface of the second pocket and is sized and shaped to hold a beverage container. The container sling is sized, shaped and located to be storable within the second pocket when not needed to hold a beverage container.

Yet another variation of the invention further comprises an interior storage compartment and means to access the storage compartment.

Still another variation further comprises additional storage pockets on the outer surface of the hip pouch.

In still a further variation of the invention the support sling is formed of a mesh material.

In a final variation, the invention further comprises a neck pad. The neck pad is slidably mounted to the neck strap.

DESCRIPTION OF THE DRAWINGS

FIG. 3 is a perspective view of the FIG. 1 embodiment illustrating the attachment of the support sling, formed of a mesh material, to the interior surface of the first pocket;

FIG. 4 is a perspective view of the FIG. 1 embodiment illustrating a wearer carrying a baby in the support sling; and FIG. 5 is a perspective view of a second embodiment of the invention, illustrating the leg and back strap and slidably mounted neck pad;

DETAILED DESCRIPTION OF THE PREFERRED EMBODIMENT

Figure 1:
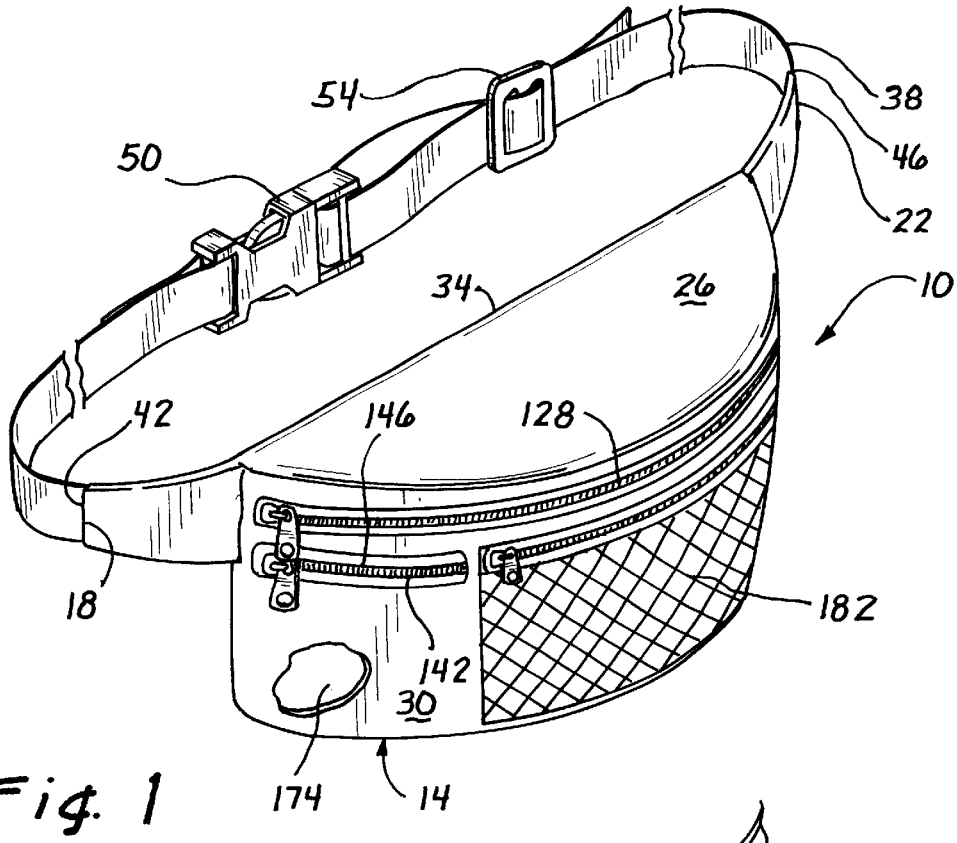
FIG. 1 is a perspective view of a first embodiment of the invention, illustrating the hip pouch and adjustable waist strap.
Figure 2:
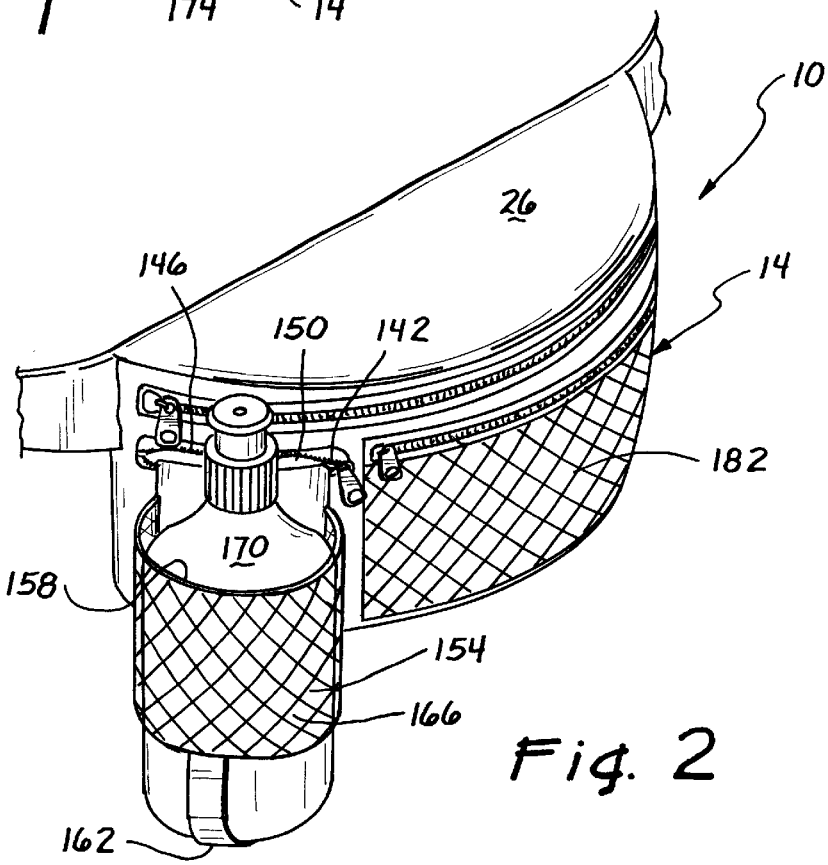
FIG. 2 is a perspective view of the first embodiment of the invention, illustrating the beverage container sling and additional storage compartments.

As illustrated in FIGS. 1–5, the hip pouch baby carrier 10 may be constructed from the following components. As shown in FIGS. 1 and 2, a hip pouch 14 fabricated from flexible material is provided. The hip pouch 14 has a first end 18, an opposite second end 22, a top surface 26, an outer surface 30 and an inner surface 34.

An adjustable length waist strap 38 is provided. The waist strap 38 has a first end 42, a second end 46, a detachable coupling means 50 and an adjustment means 54 located between the first end 42 and second end 46. The waist strap 38 is attached at its first end 42 to the first end 18 of the hip pouch 14 and at its second end 46 to the second end 22 of the hip pouch 14.

As illustrated in FIG. 3, a first pocket 58 located on the inner surface 34 of the hip pouch 14 is provided. The first pocket 58 has a top opening 62 and an interior surface 66. A collapsible support sling 70 is provided. The support sling 70 has a first side 74, a second side 78, an inner surface 82, an outer surface 86, a lower attachment point 90 and first 94 and second 98 upper attachment points. The support sling 70 is fixedly attached to the interior surface 66 of the first pocket 58.

An adjustable length neck strap 102 is provided. The neck strap 102 has a first end 106, a second end 110 and a length adjustment means 114. The neck strap 102 is fixedly attached at its first end 106 to the first upper attachment point 94 of the support sling 70 and at its second end 110 to the second upper attachment point 98 of the support sling 70.

As illustrated in FIG. 4, the support sling 70 is sized, shaped and located to secure a baby against the hip of a wearer with the baby resting upon the top surface 26 of the hip pouch 14 with each of its legs disposed over one of the first 74 and second 78 sides of the sling 70. As shown in FIGS. 1 and 2, the support sling 70 and the neck strap 102 are sized, shaped and located to be storable within the first pocket 58 when not needed to support a baby.

In a variation of the invention 10, illustrated in FIG. 5, the hip pouch baby carrier further comprises a leg and back strap 118. The leg and back strap 118 has a first end 122, a second end 126 and an intermediate portion 130. The leg and back strap 118 is fixedly attached at the first end 122 to the first side 74 of the support sling 70 adjacent the lower attachment point 90. It is attached at its intermediate portion 130 to the outer surface 86 of the support sling 70 between the first 94 and second 98 upper attachment points and the lower attachment point 90. The leg and back strap 118 is attached at its second end 126 to the second side 78 adjacent the lower attachment point 90.

The leg and back strap 118 provides a first leg opening 134 formed between the leg and back strap 118 and the first side 74 of the support sling 70 and a second leg opening 138 formed between the leg and back strap 70 and the second side 78 of the support sling 70. In use, when a baby is placed in the support sling 70 with a first leg in the first leg opening 134 and a second leg in the second leg opening 138 the baby will be constrained from slipping out of the support sling 70.

In another variation of the invention 10 the leg and back strap 118 is formed of elastic material.

In still another variation of the invention 10, as illustrated in FIGS. 1 and 2, a second pocket 142 is provided. The second pocket 142 has a top opening 146 and an interior surface 150. A container sling 154 is provided. The container sling 154 is formed of flexible material and has an open top 158, a closed bottom 162 and at least one side wall 166 joining the top 158 and the bottom 162. The container sling 154 is fixedly attached to the interior surface 150 of the second pocket 142 and is sized and shaped to hold a beverage container 170. The container sling 154 is sized, shaped and located to be storable within the second pocket 142 when not needed to hold a beverage container 170.

Yet another variation of the invention 10, illustrated in FIG. 1, further comprises an interior storage compartment 174 and means 178 to access the storage compartment 174.

Still another variation, illustrated in FIGS. 1, 2 and 5, further comprises additional storage pockets 182 on the outer surface 30 of the hip pouch 14.

In still a further variation of the invention 10 the support sling 70 is formed of a mesh material.

In a final variation, the invention 10, illustrated in FIG. 5, further comprises a neck pad 186. The neck pad 186 is slidably mounted to the neck strap 102.

While several embodiment of the present invention 10 have been illustrated and described in detail, it is to be understood that this invention is not limited thereto and may be otherwise practiced within the scope of the following claims.

What is claimed is:

1. A hip pouch baby carrier, comprising:

a hip pouch fabricated from flexible material, said hip pouch having a first end, an opposite second end, a top surface, an outer surface and an inner surface;

an adjustable length waist strap, said waist strap having a first end, a second end, a detachable coupling means and an adjustment means disposed between said first and second ends;

said waist strap attached at its first end to the first end of the hip pouch and at its second end to the second end of the hip pouch;

said inner surface being that surface disposed against the hip of a wearer of the hip pouch when the waist strap is fastened about a waist of the wearer;

a first pocket disposed upon the inner surface of the hip pouch, said first pocket having a top opening disposed upon said inner surface and an interior surface;

a collapsible support sling, said support sling having a first side, a second side, an inner surface, an outer surface, a lower attachment point and first and second upper attachment points;

said support sling being fixedly attached to the interior surface of the first pocket;

an adjustable length neck strap, said neck strap having a first end, a second end and a length adjustment means;

said neck strap being fixedly attached at its first end to the first upper attachment point and at its second end to the second upper attachment point;

said support sling being sized, shaped and disposed to secure a baby against the hip of a wearer with the baby resting above the hip pouch with each of its legs disposed over one of the first and second sides of the sling; and said support sling and said neck strap being sized, shaped and disposed to be storable within the first pocket when not needed to support a baby.

2. A hip pouch baby carrier as described in claim 1, further comprising:

a leg and back strap, said leg and back strap having a first end, a second end and an intermediate portion;

said leg and back strap being fixedly attached at said first end to the first side of the support sling adjacent the lower attachment point, at its intermediate portion to the outer surface of the support sling between the first and second upper attachment points and the lower attachment point, and at its second end to the second side adjacent the lower attachment point;

said leg and back strap providing a first leg opening formed between the leg and back strap and the first side of the support sling and a second leg opening formed between the leg and back strap and the second side of the support sling; and whereby, when a baby is placed in the support sling with a first leg in the first leg opening and a second leg in the second leg opening the baby will be constrained from slipping out of the support sling.

3. A hip pouch baby carrier as described in claim 2 wherein the leg and back strap is formed of elastic material.

4. A hip pouch baby carrier as described in claim 1, further comprising:

a second pocket, said second pocket having a top opening and an interior surface;

a container sling, said container sling formed of flexible material and having an open top, a closed bottom and at least one side wall joining said top and said bottom;

said container sling being fixedly attached to the inner surface of the second pocket and being sized and shaped to hold a beverage container; and said container sling being sized, shaped and disposed to be storable within the second pocket when not needed to hold a beverage container.

5. A hip pouch baby carrier as described in claim 1 further comprising additional storage pockets on the outer surface of the hip pouch.

6. A hip pouch baby carrier as described in claim 1 wherein the support sling is formed of a mesh material.

* * * * *